US010648332B2

(12) United States Patent
Suhonen

(10) Patent No.: US 10,648,332 B2
(45) Date of Patent: May 12, 2020

(54) INJECTION TOOL AND A METHOD FOR INJECTION

(71) Applicant: Ferramill Oy, Helsinki (FI)

(72) Inventor: Kasper Suhonen, Tampere (FI)

(73) Assignee: Ferramill Oy, Helsinki (FI)

( * ) Notice: Subject to any disclaimer, the term of this patent is extended or adjusted under 35 U.S.C. 154(b) by 0 days.

(21) Appl. No.: 16/478,865

(22) PCT Filed: Jan. 24, 2018

(86) PCT No.: PCT/FI2018/050058
§ 371 (c)(1),
(2) Date: Jul. 18, 2019

(87) PCT Pub. No.: WO2018/142023
PCT Pub. Date: Aug. 9, 2018

(65) Prior Publication Data

US 2019/0376387 A1 Dec. 12, 2019

(30) Foreign Application Priority Data

Feb. 2, 2017 (FI) ..... 20175091

(51) Int. Cl.
*E21D 20/02* (2006.01)
*E21D 9/00* (2006.01)

(52) U.S. Cl.
CPC ..... *E21D 9/001* (2013.01); *E21D 20/028* (2013.01)

(58) Field of Classification Search
CPC ..... E21D 20/028
(Continued)

(56) References Cited

U.S. PATENT DOCUMENTS 2,960,831 A 11/1960 Lonaberger et al.
3,212,269 A 10/1965 Olsen
(Continued)

FOREIGN PATENT DOCUMENTS

CN 2329764 Y 7/1999
GB 639074 A 6/1950
(Continued)

OTHER PUBLICATIONS

Finnish Patent and Registration Office, search report of Finnish patent application No. 20175091, dated Sep. 1, 2017, 2 pages.

*Primary Examiner* — Sunil Singh
(74) *Attorney, Agent, or Firm* — Berggren LLP

(57) ABSTRACT

This invention relates to an injection tool which comprises a longer smaller diameter pipe assembled movable inside a shorter larger diameter pipe, a connection piece assembled at the first end of the smaller diameter pipe, a projecting part connected to the smaller diameter pipe near the connecting piece, the projecting part having an opening or groove for a bolt, a projecting part connected near to the first end of the larger diameter pipe the projecting part having threaded opening for the bolt, the bolt connecting the projecting parts and the bolt having a fixed stopper plate, a nose piece assembled to the second end of the smaller diameter pipe, a press plate assembled to the second end of the larger diameter pipe and a sealing rubber around the smaller diameter pipe situated between the nose piece and the press plate. This invention also relates to a method for injection which comprises the steps of entering the injection tool to the borehole, tightening the injection tool to the borehole, connecting the injection machine to the injection tool, starting the injection, and an forming automatically functioning valve to the nose piece at the second end of the injection tool.

14 Claims, 2 Drawing Sheets

(58) Field of Classification Search
USPC ..... 299/11; 405/259.5, 259.6, 269
See application file for complete search history.

(56) References Cited

U.S. PATENT DOCUMENTS

| | | | |
|---|---|---|---|
| 3,984,988 | A | 10/1976 | Portier |
| 4,260,295 | A | 4/1981 | Vestlund |
| 4,362,440 | A | 12/1982 | Glaesmann et al. |
| 5,012,803 | A | 5/1991 | Foley et al. |

FOREIGN PATENT DOCUMENTS

| | | | | |
|---|---|---|---|---|
| RU | 2029093 | C1 | * | 2/1995 |
| WO | 9956001 | A1 | | 11/1999 |
| WO | 2014091074 | A1 | | 6/2014 |

* cited by examiner

INJECTION TOOL AND A METHOD FOR INJECTION

PRIORITY

This application is a U.S. national application of the international application number PCT/FI2018/050058 filed on 24 Jan. 2018, which claims priority of Finnish application FI20175091 filed on Feb. 2, 2017, the contents of all of which are incorporated herein by reference.

FIELD OF THE INVENTION

This invention relates to an injection tool and a method for injection. More precisely the invention is about a reusable injection tool and a method related to it.

BACKGROUND OF THE INVENTION

Injection tools are used in mining industry. When, for example, tunnels are mined through rock it is necessary to seal all cracks in the surrounding rock material to avoid water leaking through the cracks or prevent loose parts of the rock material coming out of the walls. This kind of sealing of the tunnel walls is done by drilling large number of boreholes to the surrounding rock material. Into these boreholes injection tools are inserted and secured to the holes. Through these injection tools appropriate concrete or other similar liquid material is injected. The injected material is penetrating into the cracks of the rock material and when the liquid material has become hard the tunnel will be safer concerning any falling rocks from the ceiling. This kind of procedure prevents also surrounding groundwater entering the tunnel, which is also used in underwater constructions.

The boreholes which are used for the injection are typically a few meters deep but they can also be as deep as 10-20 meters. In that case the point of the injection tool is inserted to the borehole and the injection tool is secured to its place with multiple washers which are pressed against the walls of the borehole. These washers keep the injection tool in its place and prevent the injected liquid material flowing out of the borehole. The pressures used for the injection are high so that the liquid material fills all cracks and seals them. High pressures mean also high risks to the safety of the workers. If the washers slip in the borehole the entire injection tool is "shot out" from the borehole and could cause severe injuries to the workers. It is not possible to tighten the injection tool after the injection is started. The tightening of the injection tool to the borehole is done by hand. It is hard work in a challenging environment and therefore this procedure is highly exposed to human errors. There is a typically a hand operated valve at the end of the injection tool close to the connecting piece which connects the injection tool to the injection machine.

When the injection is done the valve in the injection tool is closed and the injection tool is left in the borehole until the injected liquid material is hardened. The injected material is hardening also inside the injection tool and in the borehole if there are any leaks through the sealing washers. Therefore the injected material is also gluing the injection tool to the borehole. This is problematic if there is a need to bore the borehole open for another injection in case the first injection does not seal the surrounding rock material completely. It is much more difficult job to drill through the injection tool than it is to drill through the hardened sealing material.

It is also expensive to use one injection tool for every borehole, because at a typical working site there can be thousands of boreholes used for the injection. This also involves a lot of injection tools to be transported to the working site when it can be a long way underground.

If the separation of the injection tool from the borehole will succeed the tool is filled with hardened injection material. It is not possible to clean the tool for further use. The tool is simply not reusable.

The drawbacks and problems of the prior art solutions are:

- the injection tool is disposable
- the borehole is not reusable
- cannot be reassembled if the sealing between the injection tool and the wall of the borehole is leaking
- hand tightened injection tool
- high material traffic to the working site.

BRIEF SUMMARY OF THE INVENTION

These aforementioned drawbacks and problems of the prior art solutions can be solved by the solutions of the present invention. The present invention is-introduces an injection tool and a method for the injection which enable to use the injection tool several times.

BRIEF DESCRIPTION OF THE DRAWINGS

The invention is now described in more detail referring to the drawings where.

DETAILED DESCRIPTION OF THE INVENTION

Figure 1:
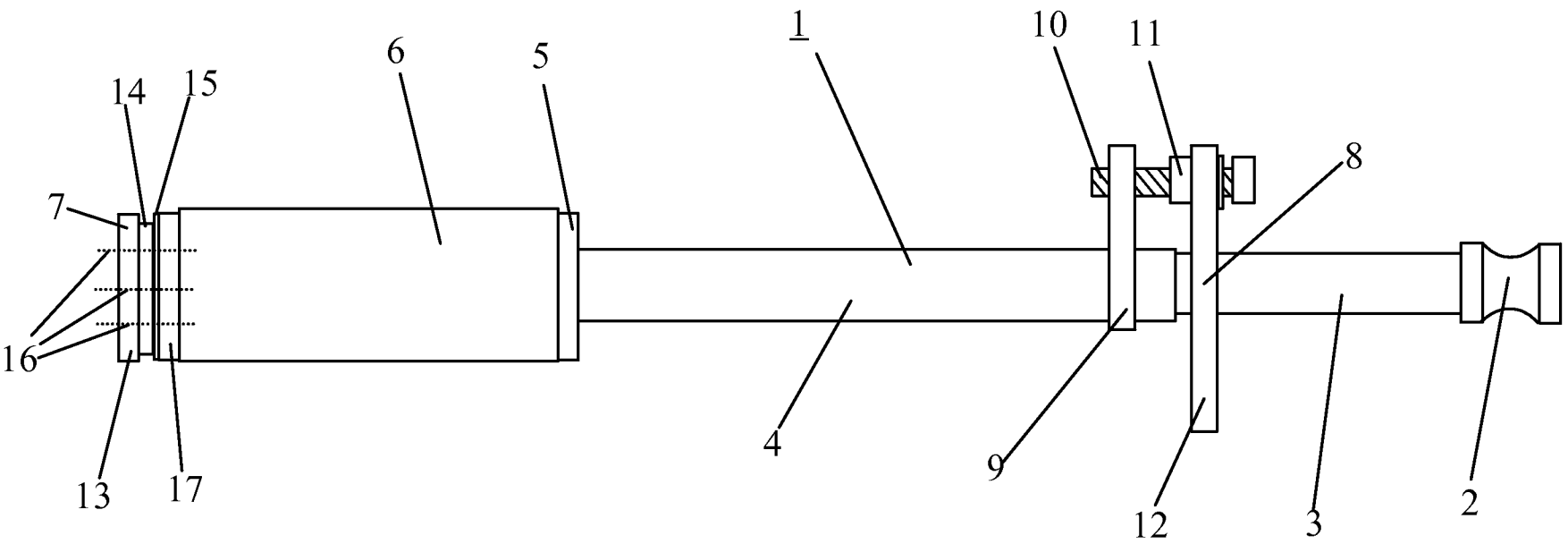
FIG. 1 is a side view drawing of one advantageous embodiment of the injection tool.

FIG. 1 shows a side view drawing of one advantageous embodiment of the injection tool 1. The injection tool 1 has a connecting piece 2 to connect the injection tool to injection machine assembled to the end of the injection tool. Through connecting piece 2 the injected liquid material enters into the injection tool 1. In the prior art solutions there is a valve, which is closed after the injection, close to the connecting piece 2. The injection tool 1 is formed of two pipes 3 and 4. The smaller diameter pipe 3 is connected to the connecting piece 2 for example by welding by its first end. The smaller diameter pipe 3 enters through the larger diameter pipe 4, through the opening of the press plate 5, through the opening of the sealing rubber 6 and is threaded to the nose piece 7 from its second end. To the smaller diameter pipe 3 is also welded a projecting part 8. The projecting part 8 can simply be a rectangular piece of a 7-20 mm thick metal plate having an opening for the smaller diameter pipe 3. The projecting part 8 is used together with a projecting part 9 and a bolt 10 to compress the sealing rubber 6. The sealing rubber 6 is simply a cylindrical piece of rubber or something similar material with a hole through the cylinder. The hole is large enough for the smaller diameter pipe 3 to go through the sealing rubber 6.

The length of the injection tool 1 can be varied corresponding to the depth of the borehole. This is done by adjusting the length of the smaller and larger diameter pipes 3 and 4 to the depth of the borehole. There is no need for the injection tool to reach the bottom of the borehole. Instead it is necessary for the sealing rubber 6 of the injection tool to reach solid material where the sealing of the tool is advantageous to be made. In this way the injected material is filling the rest of the borehole and from there filling the surrounding cracks.

The projecting part 9 is welded to the first end of the larger diameter pipe 4 and can simply also be a rectangular piece of a 7-20 mm thick metal plate having an opening for the larger diameter pipe 4. The projecting part 8 has a hole or a groove without threads where the bolt 10 is situated. The projecting part 9 has a threaded hole for the bolt 10. To the bolt 10 is attached, preferably by welding, a stopper plate 11 which is situated against the inner side of the projecting part 8. When bolt 10 is turned the projecting parts 8 and 9 can be moved further apart from each other. This movement is causing the press plate 5 at the second end of the larger diameter pipe 4 and the nose piece 7 of the injection tool 1 to move closer to each other. At the same time the sealing rubber 6, situated between the press plate 5 and the nose piece 7, is compressed longitudinally at both ends and the diameter of the sealing rubber is expanding. This effect is sealing the injection tool 1 to the borehole. The press plate 5 can be freely assembled or welded to the second end of the larger diameter pipe 4 and is situated around the smaller diameter pipe 3. It is easy to tighten the sealing rubber 6 to the borehole by turning the bolt 10 with a power tool. This movement is pressing the second end of the larger diameter pipe 4 against the press plate 5 and the press plate against the sealing rubber 6. Turning the bolt 10 with the power tool is ensuring the quick and adequate amount of compression to the sealing rubber 6. It is fast and reliable method compared to the prior art method where the sealing of the injection tool to the borehole is done by hand. It is possible to choose freely the length of the sealing rubber 6 or construct the injection tool 1 so that it comprises two or more sealing rubbers 6 with separate tightening mechanisms. This is done by adding a third pipe to the structure so that there are now two separate tightening mechanisms for the sealing rubbers 6. It is advantageous to make the first tightening mechanism with coarse thread and the second tightening mechanism with fine thread. This enables fast tightening with the first mechanism and more power transferred with the second tightening mechanism. It is also advantageous to use solid washers that are similar to press plate 5 between multiple sealing rubbers 6 when they are used in the construction.

The projecting part 8 has also advantageously a projection 12 to the other side of the smaller diameter pipe 3. This projection 12 is used for removing the injection tool 1 from the borehole if the injection tool is stuck in the borehole. It is easy to tap the projection 12 with a hammer or such to create small movement to the injection tool 1 and separate it from the borehole. It is also possible to treat the nose piece 7 with a releasing agent to ensure the easy removal of the injection tool 1 from the borehole.

If any more secure tightening of the injection tool 1 to the borehole is needed there is always a possibility to add additional, for example some "spike like", fastening members to the injection tool. These spikes are advantageously placed close to the first end of the larger diameter pipe 4. Any suitable mechanism can be used for operating these spikes. These extra spikes can create more secure attachment of the injection tool 1 to the borehole when needed especially if worked with poor quality rock.

The nose piece 7 comprises four parts which are connected together for example with three bolts. The number of bolts or other connecting members can be varied. The most outer part of the nose piece 7 is a ring plate 13. Under the ring plate 13 there is a circular rubber plate 14 and a support plate 15. All these three parts 13, 14 and 15 are connected with bolts 16 to the connecting plate 17. These parts are described more detailed in FIGS. 2*a*-2*d*. The nose piece 7 is acting as a valve for the injected material. Therefore, compared to the prior art solutions, the valve has been transferred from the first end of the injection tool 1 to the second end of the injection tool.

Figure 2A:
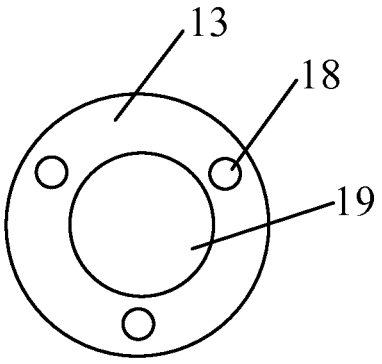
FIG. 2*a*-2*d* are drawings of the parts of the nose piece separately.

In FIG. 2*a* the ring plate 13 is presented. The ring plate 13 has three unthreaded holes 18 for the bolts 16 (not presented in FIG. 2*a*) and in the middle of the plate there is an opening 19 for the liquid injection material.

Figure 2B:
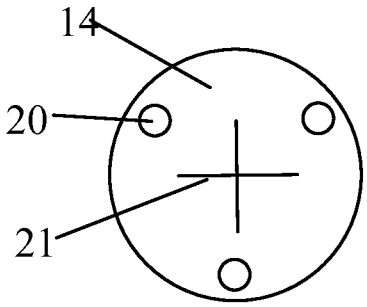

FIG. 2*b* shows the rubber plate 14. The rubber plate 14 has three holes 20 for the bolts 16. In the middle of the rubber plate 14 is a cross shaped cut 21 through the rubber plate. When the liquid injection material enters through the injection tool to the rubber plate 14 with a pressure, the rubber plate is expanding and the cross like cut 21 is opening allowing the liquid injection material to enter through the nose piece 7. When the pressure is reduced the cross shaped cut 21 is closed. The thickness of the rubber plate 14 is selected and varied according to the injected material and the injection pressure. Also the material of the rubber plate 14 can be varied and this can also affect to the thickness of the rubber plate. Typically the thickness is 2-20 mm and more preferably 3-12 mm. The nose piece 7 can also be constructed so that the rubber plate 14 has a smaller diameter and does not extend to the bolts and therefore it does not have any bolt holes 20. Also the shape of the cut is not limited to the "cross shape". Any shaped cuts can act as a valve in the nose piece.

Figure 2C:
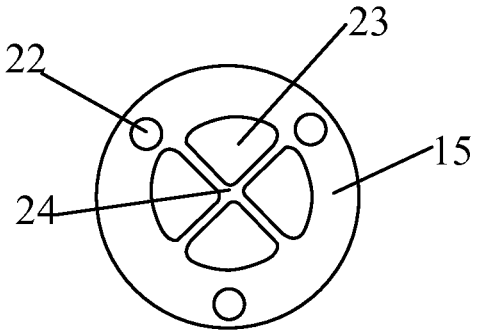

In FIG. 2*c* the support plate 15 is presented. The support plate 15 has openings 22 for the bolts 16 and four openings 23 which are forming a cross shaped FIG. 24 to the support plate. The support plate 15 is situated so that the arms of the cross shaped FIG. 24 are supporting the rubber plate 14 so that the pressure in the borehole cannot expand the rubber plate backwards when the injection pressure is reduced. The nose piece can also be constructed so that the support plate 15 has a smaller diameter and it does not extend to the bolts 16 and therefore does not have any bolt holes 22. The support plate 15 is naturally designed to be used in combination with the rubber plate 14 so that the support arms of the cross shaped FIG. 24 keep the rubber plate closed when the injection pressure is removed.

Figure 2D:
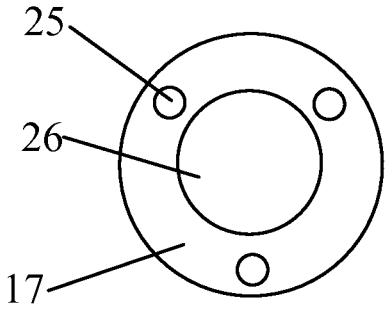

FIG. 2*d* shows the connecting plate 17. The connecting plate 17 has three treaded holes 25 for the bolts 16. With the bolts 16 all four parts are connected together to form the nose piece 7. The connecting plate 17 has a threaded opening 26 in the middle. By these threads the nose piece 7 is connected to the second end of the smaller diameter pipe 3 which has the corresponding threads on the outer surface of the second end of the pipe. The support plate 15 and the connecting plate 17 can also be manufactured as a one piece construction.

It is also possible to manufacture the nose piece 7 so that the ring plate 13 is formed together with cylindrical outer surface of the nose piece. Inside the cylinder is then placed the rubber plate 14. The cylinder has threads on the inner surface so that the support plate 15, which is manufactured together with the connecting plate 17 in one piece construction with matching threads on the outer surface, can be threaded inside the cylinder. The connection of the nose piece 7 to the smaller diameter pipe 3 can be done also with grooves and matching protrusion to form a "snap on" connection.

When the injection material is entering through the injection tool 1 to the borehole the injection tool is secured to its place by the sealing rubber or rubbers 6. If there is detected any leaks the sealing rubber 6 can be simply tightened more by turning the bolt 10 with the power tool. When the injection pressure is reduced the nose piece 7 is closed as the rubber plate 14 is pressed against the support plate 15 and the cross shaped cuts 21 are closed. After that the injection tool 1 can be disconnected from the injection machine and is preferably washed with water for removing any injection material from the inside of the injection tool. This is preferable at least for the boreholes that are directed downwards so that the injection tool 1 cannot "leak" the injected material out of the injection tool with help of the gravity. The injection tool 1 is reusable after removed from the borehole. This is due the fact that the valve is situated to the nosepiece 7 of the injection tool 1 at the second end of the injection tool and not at the first end (connecting the injection tool to the injection machine) of the injection tool. Therefore the inside of the injection tool 1 can be cleaned right after the injection pressure is reduced and the injection tool is disconnected from the injection machine.

It is also possible to use two component injection materials where the components are mixed in the nose piece 7. This is possible by leading a smaller conduct inside the smaller diameter pipe 3 to the nosepiece 7 so that the end of the conduct is situated to the opening 19 of the ring plate 13. Preferably the conduct is a small pipe in the center of the nosepiece 7 so that it has extra openings in the middle of the support plate 15 and in the middle of the rubber plate 14. Typically one part, a hardener of the two component injection material is very small compared to the other part and therefore the small pipe is also very small. The two parts are mixed together at the opening 19 of the ring plate 13 of the nosepiece 7 and injected further by the pressure generated in the injection machine.

The injection tool 1 is changed very easily to fit larger or smaller diameter borehole. The only parts that are changed are the nosepiece 7 and the rubber sealing 6. The nosepiece 7 is removed from the threaded second end of the smaller diameter pipe 3 and a new rubber sealing 6 can be changed. It is not always necessary even to change the nosepiece 7 when entering to a larger diameter borehole. Only a suitably sized rubber sealing 6 is enough. It is also advantageous to use solid washer similar to the press plate 5 between the nose piece 7 and the sealing rubber 6 when the nose piece has a smaller diameter than the sealing rubber.

There are very few pieces that wear during the use of the injection tool 1. When there is a need to replace some worn parts of the injection tool 1 the job is done very easily. There is no need to replace the whole injection tool 1.

The method for injection comprises the following steps:

- inserting the injection tool 1 to the borehole,
- sealing the injection tool 1 to the borehole by compressing longitudinally the rubber sealing 6 to enlarge the outer diameter of the rubber sealing,
- connecting the injection tool 1 to the injection machine,
- producing the injection pressure with the injection machine for injecting the injecting material through the injection tool 1 to the borehole and automatically opening the valve in the form of the rubber plate 14,
- reducing the injection pressure and automatically closing the valve in form of the rubber plate 14,
- washing the inside of the injection tool 1 with water if necessary
- after the injected material is hardened the injection tool 1 is removed from the borehole by releasing the compression of the rubber sealing 6,
- the injection tool 1 can be reused in the next borehole.

The method can also include tightening of the injection tool 1 in two parts with two tightening mechanism having coarse and fine threads.

The nose piece 7 can also be treated with release agent to ensure the removal of the injection tool 1 from the borehole. Also the projecting part 12 can be hit for example with a hammer to release the injection tool 1 out of the borehole.

The benefits of this invention comparing to prior art solutions are for example

- easy and secure installation,
- fast installation, no additional separate parts needed,
- easy removing,
- effective mechanical tensioning,
- can be used in all injections,
- reusable (the number of times the injection tool can be reused is high, up to 25 uses without the need of replacing spare parts),
- can be washed immediately after the injection,
- easy to change the borehole size,
- no extra taps,
- affordable and easy to maintain,
- simple structure and easy to manufacture,
- all components replaceable,
- speeds up working times in injections,
- the components of the injection tool are quick and easy to disassemble and no tools are necessarily needed for disassembling them,
- in very poor quality rock, it is possible to put several pieces of sealing rubbers behind each other and the tension power can be increased with longer bolts,
- the injection tool can be manufactured with different measurements, for different sized boreholes,
- the advantage to a disposable prior art injection tool is the fact that nothing is left in the borehole from the injection tool, and the borehole can be reopened without breaking the drilling equipment,
- the worn parts of the reusable injection tool can be manufactured as spare parts,
- the injection tool is one package and does not have separately transported parts, and
- the removal of the injection tool is not sensitive for the time period between the injection and the injection tool removal.

The injection tool and the method for injection are typically used in mining industry but it is possible to use the injection method and the injection tool also in other fields. For example the injection method and the injection tool according to the invention can be used in repairing concrete structures that have cracks inside the structure. The structures of this kind are for example the dams, the foundations of the buildings or other massive concrete structures.

These examples are not limiting the scope of the protection. The scope of protection is defined by the following set of claims.

The invention claimed is:

1. An injection tool, comprising:

a longer smaller diameter pipe assembled movable inside a shorter larger diameter pipe;

a connection piece assembled at a first end of the smaller diameter pipe; and a nose piece assembled to a second end of the smaller diameter pipe, wherein the nose piece comprises a ring plate, a rubber plate, a support plate and a connecting plate connected together to form the nose piece.

2. The injection tool according to claim 1, wherein the support plate and connecting plate is a one-piece construction.

3. The injection tool according to claim 1, wherein the nose piece comprises the ring plate formed together with cylindrical outer surface of the nose piece having threads at the inner surface and having the rubber plate placed inside the cylinder so that the support plate has matching threads on the outer surface and is threaded inside the cylinder.

4. The injection tool according to claim 1, wherein the nose piece includes any shaped cut in the rubber plate to form an automatically functioning valve for an injected material.

5. The injection tool according to claim 1, wherein the injection tool is reusable.

6. The injection tool according to claim 1, wherein the injection tool has a first projecting part connected to the smaller diameter pipe near the connection piece, the first projecting part having an opening or groove for a bolt, a second projecting part connected near to a first end of the larger diameter pipe, the second projecting part having threaded opening for the bolt, the bolt connecting the first and second projecting parts, and the bolt having a fixed stopper plate.

7. The injection tool according to claim 1, wherein the injection tool has a press plate assembled to a second end of the larger diameter pipe, at least one sealing rubber around the smaller diameter pipe situated between the nose piece and the press plate.

8. A method for injecting a material comprising the steps of:

a) entering the injection tool of claim 1 into a borehole, b) tightening the injection tool to the borehole, c) connecting an injection machine to the injection tool, and d) starting to inject the material into the injection tool, wherein e) any shaped cut in the rubber plate forms an automatically functioning valve in the nose piece at a second end of the injection tool.

9. The method for injecting a material according to claim 8, wherein when the injection is done the valve in the injection tool is closed and injection tool is removed from the borehole and washed.

10. The method for injecting a material according to claim 8, wherein tightening of the injection tool to the borehole is done by a power tool.

11. The method for injecting a material according to claim 8, wherein tightening of the injection tool to the borehole is done in one or more separate steps that are similar or different.

12. The method for injecting a material according to claim 8, wherein the injection tool is tightened more while injecting the material by turning the bolt according to claim 6 with a power tool.

13. The method for injecting a material according to claim 8, wherein the injection tool is reusable.

14. The method for injecting a material according to claim 8, wherein the injection tool is removable from the borehole after the injecting material is hardened.

* * * * *